US006274986B1

(12) United States Patent
Devonshire et al.

(10) Patent No.: US 6,274,986 B1
(45) Date of Patent: Aug. 14, 2001

(54) METHOD AND APPARATUS FOR DRIVING A DISCHARGE LAMP WITH PULSES THAT TERMINATE PRIOR TO THE DISCHARGE REACHING A STEADY STATE

(75) Inventors: Robin Devonshire; Timothy James Healey; David Andrew Stone; Richard Charles Tozer, all of Sheffield (GB)

(73) Assignee: University of Sheffield, Sheffield (GB)

( * ) Notice: Subject to any disclaimer, the term of this patent is extended or adjusted under 35 U.S.C. 154(b) by 0 days.

(21) Appl. No.: 09/463,055

(22) PCT Filed: Jul. 14, 1998

(86) PCT No.: PCT/GB98/02072

§ 371 Date: Apr. 3, 2000

§ 102(e) Date: Apr. 3, 2000

(87) PCT Pub. No.: WO99/04605

PCT Pub. Date: Jan. 28, 1999

(30) Foreign Application Priority Data

Jul. 14, 1997 (GB) ..... 9714785

(51) Int. Cl.[7] ..... G05F 1/00

(52) U.S. Cl. ..... 315/291; 315/237; 315/246; 315/302; 315/340

(58) Field of Search ..... 315/291, 302, 315/334, 340, 237, 246, 167; 313/484, 485, 486, 487, 571, 572, 643

(56) References Cited

U.S. PATENT DOCUMENTS

| | | | | |
|---|---|---|---|---|
| 4,009,416 | * | 2/1977 | Lowther | 315/176 |
| 4,549,109 | * | 10/1985 | Nighan et al. | 313/485 |
| 4,792,727 | * | 12/1988 | Godyak | 315/176 |
| 5,028,845 | * | 7/1991 | Ravi et al. | 315/189 |
| 5,187,413 | * | 2/1993 | Araki et al. | 315/291 |
| 5,410,216 | * | 4/1995 | Kimoto et al. | 313/485 |
| 5,592,052 | * | 1/1997 | Maya et al. | 315/291 |

* cited by examiner

*Primary Examiner*—Haissa Philogene
(74) *Attorney, Agent, or Firm*—Morse, Altman & Martin

(57) ABSTRACT

An apparatus and method for applying short pulsed waveforms, on the order of 1 μs pulses at a frequency of about 5 kHz, to a discharge lamp, such as a low-pressure mercury/argon lamp, in order to shift the ratio of the intensities of two of the mercury lines, in particular the 254 nm and 365 nm lines, of which for a sinusoidal excitation signal the 254 nm line is predominant, towards the higher wavelength. This greatly increases the efficiency of a lamp using phosphors excited by these UV emissions, because of the reduced Stokes shift.

24 Claims, 13 Drawing Sheets

A Block Diagram of the Demonstration Lamp Driver System

Energy Level Diagram of Hg I

A Block Diagram of the Demonstration Lamp Driver System

Spectral Output of Pulse Driven Mercury Vapour Lamp f = 10kHz, Varying pulse width
$I_{supply}$ = 25mA
500ns
1.5µs
4µs
8µs
15µs
Intensity / arbitrary units
0.06
0.05
0.04
0.03
0.02
0.01
0.00
0
50
100
150
200
Time / µs

METHOD AND APPARATUS FOR DRIVING A DISCHARGE LAMP WITH PULSES THAT TERMINATE PRIOR TO THE DISCHARGE REACHING A STEADY STATE

BACKGROUND OF THE INVENTION

1. Field of the Invention

The present invention relates to discharge lamps, and in particular to the electrical control and construction of such lamps with a view to obtaining desired emission wavelength characteristics.

2. Description of the Related Art

A widely used lamp in interior lighting, the fluorescent tube, exploits the properties of a low-pressure discharge in mercury vapour (typically $7\times10^{-3}$ torr, corresponding to a wall temperature of about 40° C.) and argon gas (typically 3 torr) produced by the application of a mains, or higher, frequency alternating high voltage to a pair of either cold or heated electrodes at either end of a sealed glass tube. Such a plasma emits a number of discrete mercury emission lines by far the strongest of which is the 254 nm resonance line (up to 60% of the total lamp input power can appear in this line). The intense 254 nm UV radiation is converted to useful broadband visible radiation by a coating of red, green and blue phosphors on the inside walls of the glass envelope.

A major known disadvantage of the fluorescent lamp is the large difference in energy (inversely proportional to the wavelength of the radiation) between the exciting radiation at 254 nm and the range of visible wavelengths from 400 nm to 700 nm, i.e. there is a very large "Stokes shift". In theory the 254 nm photon has sufficient energy to produce two visible photons, e.g. two at greater than 508 nm, and a process that achieved this would bring about a major advance in overall lamp efficiency. A practical process to achieve this has to date been neither implemented nor described in principle. As a consequence a large proportion (typically 75%) of the energy delivered to a standard design fluorescent lamp is wasted as heat.

Recently it has been demonstrated that the colour of the emission from mercury/rare-gas discharges can be altered significantly by replacing the standard alternating (sinusoidal) power supply with a pulsed power supply. M. Aono, R. Itatani et al. (J. Light & Visual Environment, vol. 3, no. 1, p. 1–9, 1989) demonstrated that the relative intensity of emissions from the rare gas itself, usually insignificant, could be greatly enhanced by pulsed excitation. This was exploited to produce lamps whose phosphor emissions changed colour according to whether alternating (sinewave) or pulsed electrical excitation was used. Hitachi have demonstrated electrical control of the colour of the emission from mercury/rare-gas lamps and from xenon lamps; see for instance JP-A-5-135744 (Shinkishi et al).

The effect has been exploited to meet particular commercial requirements. For instance, OSRAM Sylvania have described (EP-A2-700074) the pulsed excitation of a neon discharge to produce a lamp suitable both as a flashing indicator light and as a brake light for automobiles.

Matsushita have reported (JP-A-7-272672) a fluorescent lamp driven by an alternating high frequency supply supplemented with a pulsed power supply. The advantage cited was an increase in the radiant intensity of the 254 nm emission and an increase in fluorescent lamp efficiency.

EP-A1-334356 (VEB NARVA) also discusses the use of pulsed discharges to produce a desired spectral emission, though here the emphasis is on the use of high-pressure caesium and/or rubidium discharges, with possible additives, and phosphors are not used.

SUMMARY OF THE INVENTION

The invention makes use of the technology of pulsed voltage application in a somewhat different way.

To explain the invention reference will first be made to FIG. 1, which shows the main energy levels and transitions of the mercury atom. In a normal AC discharge by far the most intense emission is that corresponding to the transition from $6^3P_1$ to the ground state. As a result, the spectrum of the continuously excited mercury discharge is dominated by the line at about 254 nm.

The present invention arose as a result of a detailed investigation of the temporal behaviour of a mercury rare-gas discharge subject to such excitation. The basic observation is exemplified in FIG. 2 which shows the time-resolved emissions of mercury vapour to which a voltage pulse is applied, at 254 nm (two transitions: resonance line at 253.65 nm and the $^3D_1$–$^3P_0$ transition at 253.48 nm) and at 366 nm (four transitions: $^1D_2$–$^3P_2$ at 366.33 nm; $^3D_1$–$^3P_2$ at 366.29 nm; $^3D_2$–$^3P_2$ at 365.48 nm; and $^3D_3$–$^3P_2$ at 365.02 nm). Both sets of transitions show a step increase in intensity as the voltage pulse is applied. Subsequent behaviour, however, differentiates them. The 254 nm intensity continues to increase for a period, stays high and then falls with a characteristic time as the voltage falls at the end of the pulse. In contrast the 365–366 nm emission shows an immediate drop during the pulse-on period but shows a step increase as the pulse is turned off. After peaking at a time after the end of the pulse it shows a decay with a characteristic time which turns out to be longer than that describing the 254 nm emission immediately after the pulse. The remarkable consequence of the latter, post-pulse, effects is that integrated over an entire cycle of the repetitive pulse sequence the total intensity of the 366 nm emission exceeds that of the 254 nm emission if the cycle time is long enough.

Investigation over a wide range of conditions showed that the behaviour of these two discharge emissions at the termination of each pulse described above was characteristic of the prevailing conditions of wall temperature, and gas composition and pressure, i.e. the competing processes controlling the populations of the emitting electronic states involved.

The sustained enhancement of the 254 nm emission during the pulse arises probably from the transfer of net population from mercury ground states, $^1S_0$, to the manifold of excited states, thus reducing the radiation trapping of 254 nm radiation that is a strong feature of the operating mechanism of a fluorescent lamp. (Nute: there is probably an increase also in the emission of the other mercury resonance line at 184.96 nm during the pulse). The burst in the 366 nm emission at pulse termination arises possibly from the rapid increase in the population of highly excited mercury states produced by the neutralisation of the high density of mercury ions present during the intra-pulse period. Excited rare-gas states may also play a part.

The recognition of the relative importance of the trailing edge of applied pulses can be exploited in interesting ways. For example, a mercury/rare-gas discharge can be operated in such a way that the intensity of the 366 nm emission can significantly exceed the intensity of the 254 nm emission (in the plasma emission of a typical fluorescent tube this ratio favours the 254 nm line by a factor of over 20; see FIG. 3). Thus by optimising the design of a pulsed-operation mercury/rare-gas discharge in respect of the inter-pulse behaviour it is possible to increase the ratio of 366 nm to 254 nm radiation by a factor of at least 100.

This 366 nm to 254 nm relative enhancement, and in general the shift in emission ratios brought about by the use of pulsed excitation, can be exploited in various ways.

In a first aspect of the invention therefore there is provided a discharge lamp comprising a tube for containing the discharge medium, and a control means for applying a field to the medium so as to cause a discharge within the tube, wherein the discharge in the medium when excited by a simple alternating field contains two lines at first and second wavelengths, the first wavelength predominating, in which the control means is adapted to apply a waveform consisting of relatively short excitation pulses ("marks") and relatively long substantially non-excitation intervals ("spaces") such that the integral over one waveform period of the intensity of the light emitted at the second wavelength is greater than the corresponding integral for the first wavelength.

In the corresponding method an electrical signal is applied to a discharge lamp comprising a tube in which the discharge medium is contained in order to cause a discharge within the tube, wherein the signal consists of relatively short pulses and relatively long non-excitation intervals such that the integral over one waveform period of the intensity of the light emitted at the second wavelength is greater than the corresponding integral for the first wavelength.

Preferably the two wavelengths originate from emissions from a single or the same element in the discharge. Advantageously the active component of the discharge medium is mercury, the remainder being a rare gas such as argon or neon, and the two wavelengths are 254 nm and 366 nm respectively. In preferred embodiments the 366 nm emission is at least twice as strong as that at 254 nm. To this end the duty cycle, i.e. the ratio of the "mark" to the total period, should be between $10^{-1}$ and $10^{-3}$, preferably about $10^{-2}$. The gas pressure may be of the order of 5–30 torr and the wall temperature (cold spot temperature) about 25–30° C. The pulse width may be less than about 1 $\mu$s, preferably less than 0.5 $\mu$s and the frequency about 5–10 kHz. The tube can contain electrodes in the normal way to apply the field, the maximum voltage applied to these electrodes being about 1.4 kV and the current 1 amp.

In the case of a mercury lamp the tube can be used as a source of UVA radiation at 365 nm, but for normal lighting purposes it is preferably lined with standard phosphors for emitting at visible wavelengths when struck by the UV light produced by the mercury discharge. In the invention the spectrum of the lamp, i.e. of the discharge, is of interest from the point of view of energy distribution rather than of its colour: the lamp emits only by way of the phosphors, and the colour balance of the phosphors does not change significantly as the excitation method changes. Moreover with a mercury lamp it is the mercury lines rather than the rare-gas emissions that are of interest.

These measures result in a fluorescent lamp that is intrinsically more efficient than the standard, 254 nm driven, fluorescent lamp. The major reason for this is the considerably smaller Stokes shift involved in converting a 366 nm photon to a visible region photon. Amongst other important benefits are the more benign character of 366 nm radiation than 254 nm radiation with respect to materials degradation by UV. The phosphors on such a new generation of fluorescent lamp would be optimised for 366 nm excitation as opposed to 254 nm excitation (though they would respond to any light at 254 nm), further increasing efficiency.

The invention is applicable to any discharge lamps, not just mercury lamps, as used in buildings, vehicles or street lights. Generally it makes use of the emissions that appear after excitation has ceased, rather than during excitation, and in particular during a more-or-less steady-state discharge. Such post-excitation emissions are known to occur, for instance, in deuterium discharges in pulsed operation. The first wavelength might be either higher or lower than the second.

The invention in an alternative aspect is directed to a method of driving a discharge by applying an electrical signal to a discharge medium, in which the electrical signal is applied in a pulsed manner, the pulse being ended before the discharge reaches a steady state. Typically this might involve ending the excitation when a suitable electrical variable, such as the current through the discharge, has reached about half of its steady-state value. This typically takes about 0.5 $\mu$s.

The principle can be used to match discharge emissions of phosphors excited by these emissions so as to minimise Stokes losses. Hence in a further alternative aspect the invention is directed to a discharge lamp comprising a discharge medium and an enclosure for the medium, and means for applying an electric field to the medium, in which the wall of the enclosure is coated with a phosphor-type material emitting at a wavelength $\lambda$ and the field-applying means is adapted to apply the field in a pulsed manner at a frequency and duty cycle such that the medium discharges preferentially at a wavelength $\Lambda$, where $\Lambda/\lambda>0.6$.

In some embodiments it may be preferable for the main emission line or lines in the discharge to be within 20% of the emission of the phosphor in wavelength; for normal lighting applications, where $\lambda$ is of course visible, the wavelength should be in the near UV, say<400 nm.

In a fourth aspect the invention makes use of a pulsed discharge lamp as a source of intense, monochromatic, near-UV radiation for use in LCD backlights. In UVLCDs, i.e. LCDs using UV backlighting and phosphor emitters on the viewer side to give an output when struck by the UV, it is particularly desirable to use near-visible wavelengths for the backlighting since even 366 nm is damaging to most liquid crystal materials.

Hence in this aspect the invention is directed to a display including on the one hand a discharge lamp comprising a discharge medium and an enclosure for the medium, and means for applying an electric field to the medium in order to cause the medium to emit radiation, and on the other hand a shutter means, to which the radiation is directed, for switching the radiation in order to allow it selectively to strike a phosphor-type emitter, in which the field-applying means is adapted to apply the field in a pulsed manner at a frequency and duty cycle such that the medium discharges preferentially at a wavelength close to that at which the phosphor emits. Preferably the wavelength ratio is at least 0.6 or thereabouts. Of course, in a colour display the ratio will be higher for the blue phosphors than for the red ones.

Such a lighting system for LCDs, using the discharge light directly, is much more efficient than one using an intermediate phosphor converting to, say, 365 nm, which is an important consideration for battery-powered displays. The wavelength is preferably in the range 350–400 nm, particularly as close to the upper figure as possible in view of the considerations mentioned above.

BRIEF DESCRIPTION OF THE DRAWINGS

For a better understanding of the invention embodiments of it will now be described, by way of example, with reference to the accompanying drawings, in which.

DETAILED DESCRIPTION OF THE PREFERRED EMBODIMENTS

Figure 1:
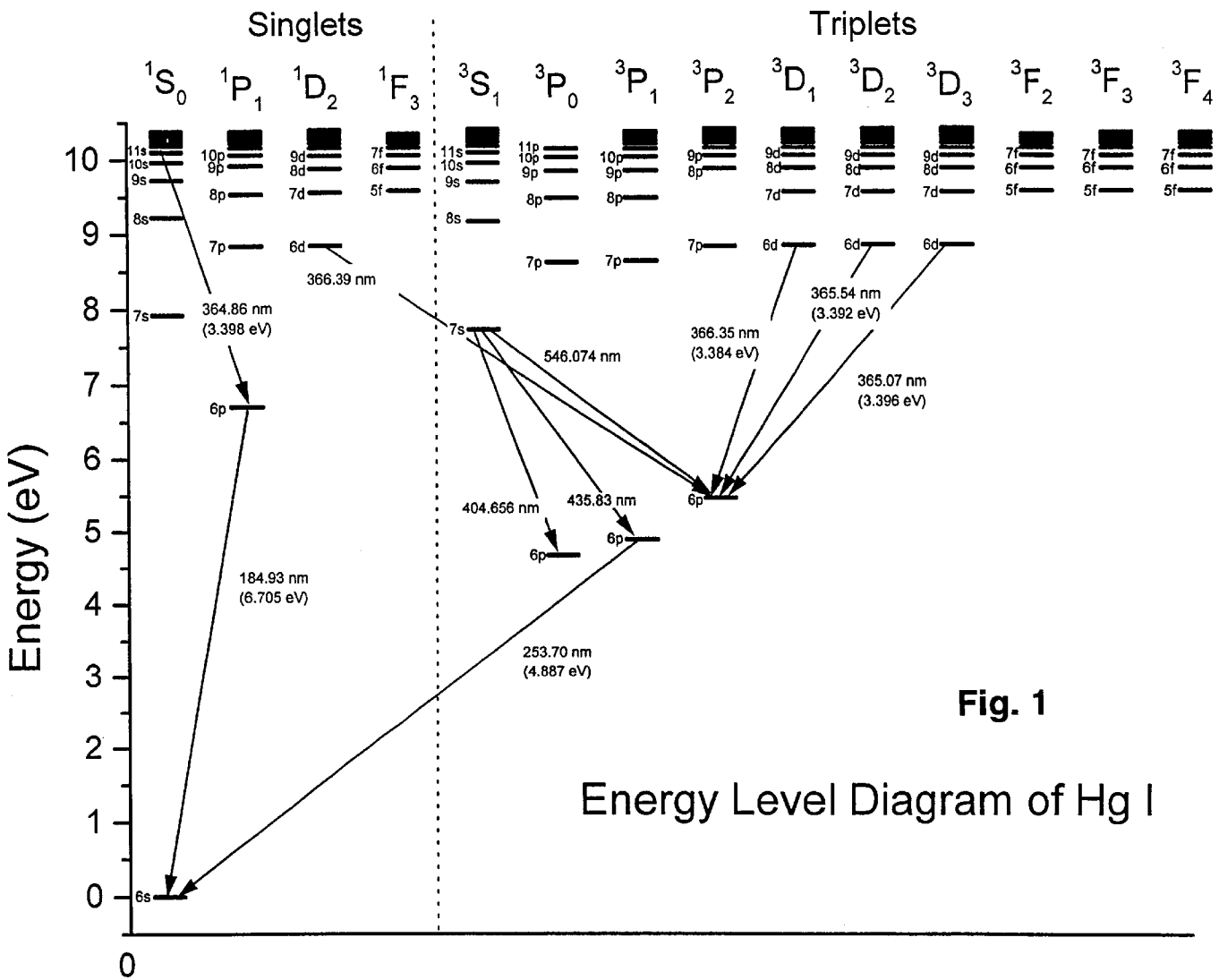
FIG. 1 is a diagram showing the principal energy levels of mercury, giving rise to the characteristic lines.
Figure 2:
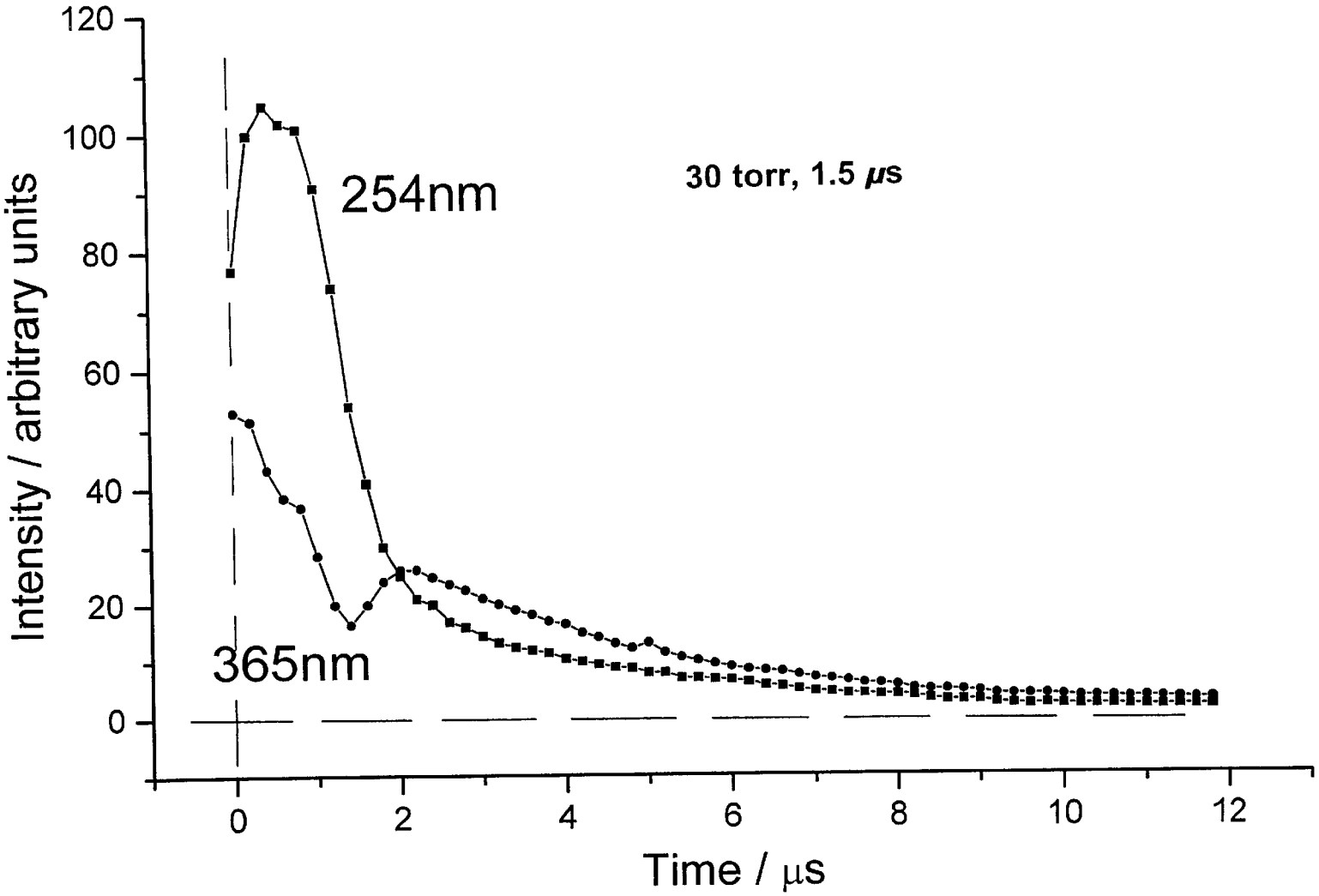
FIG. 2 shows the output versus time of a pulsed discharge.
Figure 3:
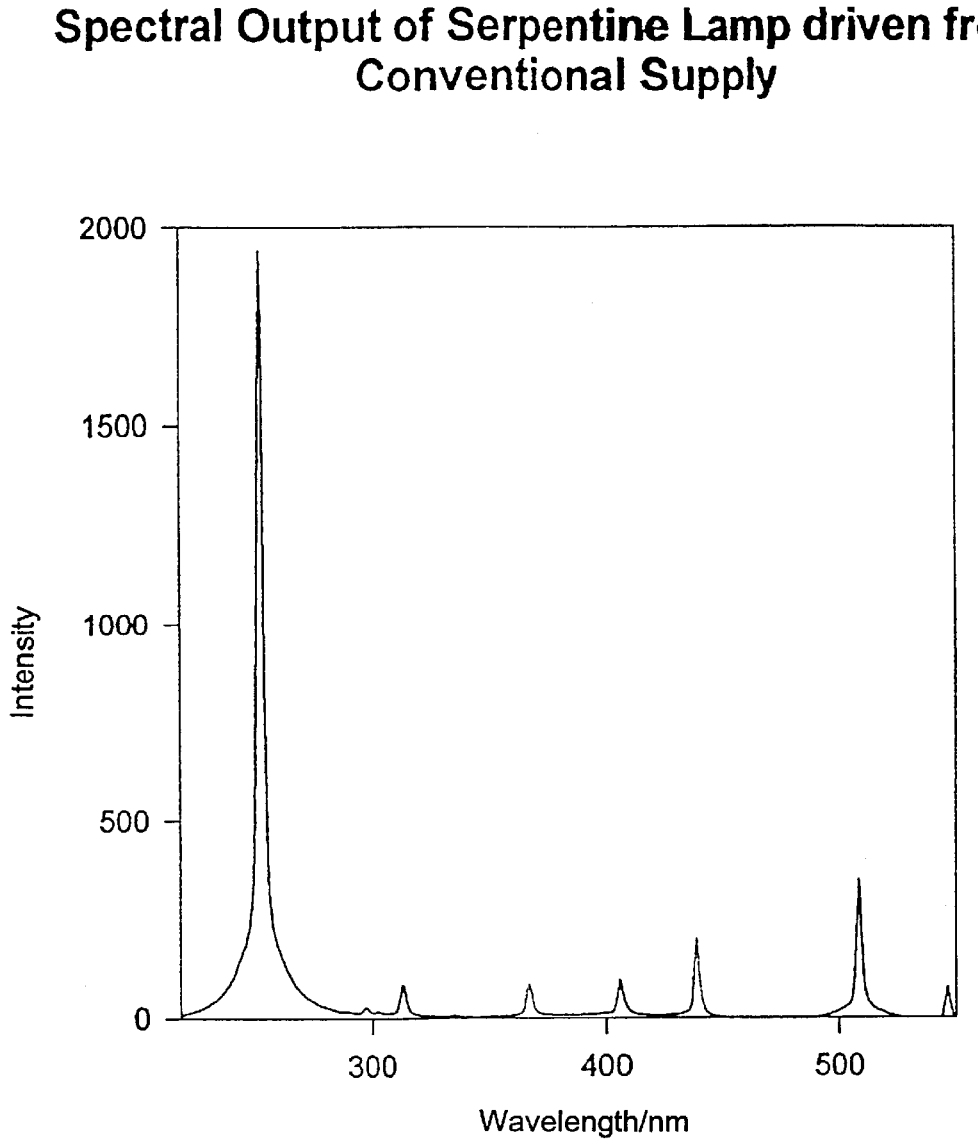
FIG. 3 PRIOR ART
FIG. 3 shows the spectral output of a serpentine lamp driven according to the prior art.

FIG. 1 shows the relevant energy levels of the Hg atom, as already discussed. In a typical low-pressure mercury vapour lamp the relative magnitudes of the emission lines can be seen from FIG. 3, where it will be observed that by far the greatest output is at 254 nm.

Figure 4A:
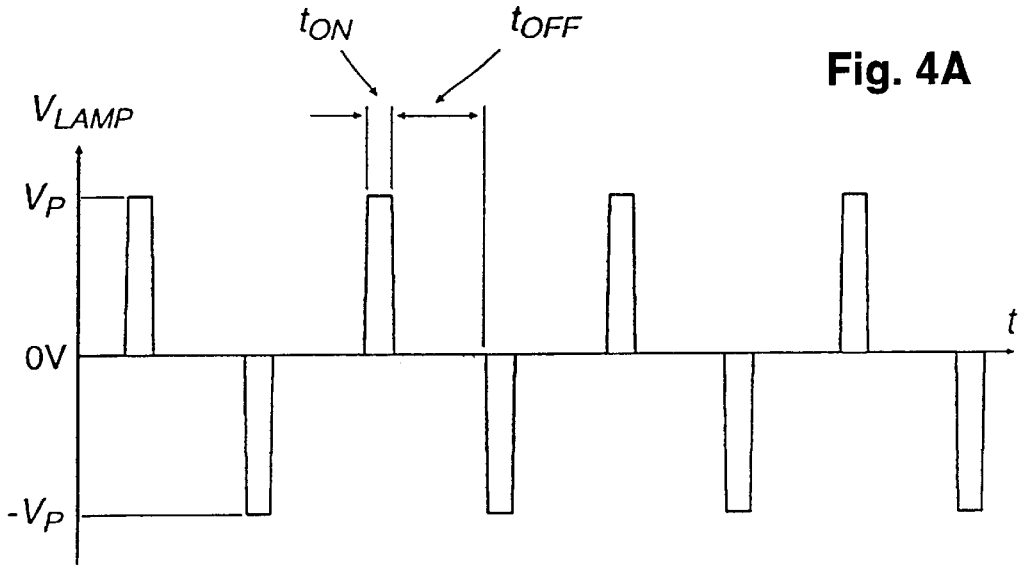
FIG. 4 shows the pulsed waveform used in the invention, FIG. 4A being a sketch of the alternating pulses used and FIG. 4B showing the trace of the initiation of a discharge.
Figure 4B:
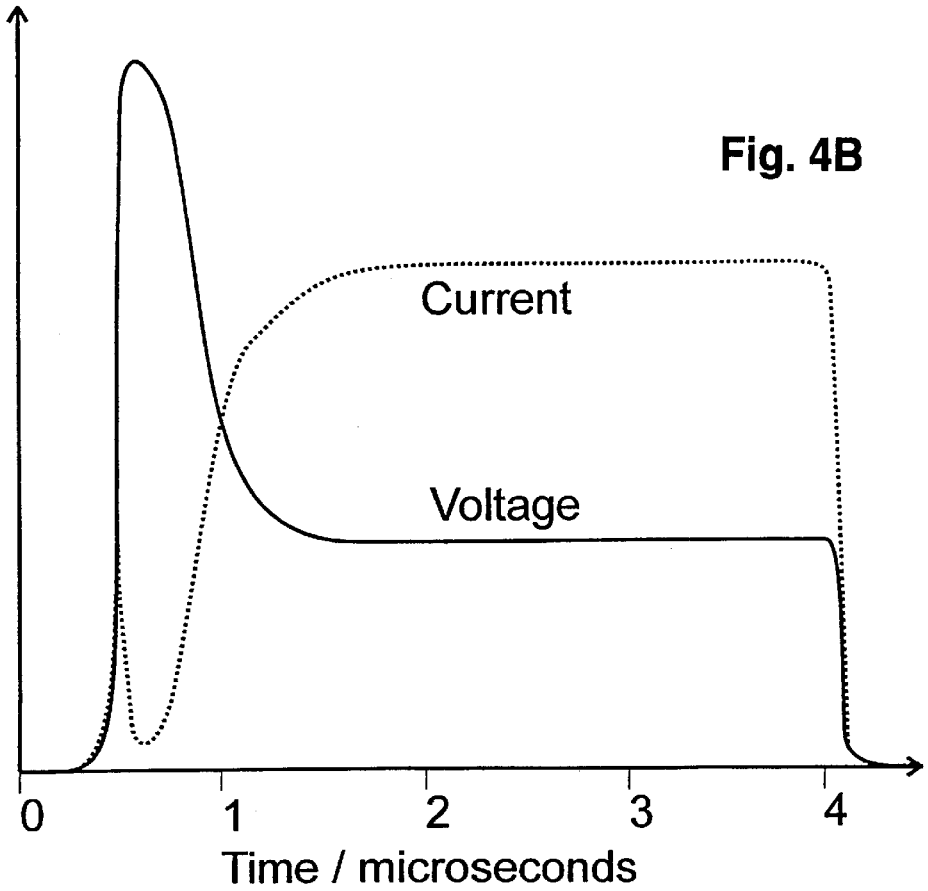

In the first embodiment of the invention the discharge is driven by pulses, as shown schematically in FIG. 4A, having a duty cycle of 0.005 and a pulse repetition frequency of 10 kHz. In order to make the maximum use of post-excitation emissions the pulse should be ended as soon as the discharge begins. As shown in FIG. 4B, where for the purposes of illustration a 5 $\mu$s pulse was applied at t=0, the voltage trace shows an initial peak and then decreases to a steady value, while the current trace shows a small initial peak thought to represent the charging of capacitative elements of the system such as the leads, and then a steady growth to a constant value. The excitation should be stopped when the discharge is about half-way to being established, i.e. after about 0.5 $\mu$s. The decay of the pulse takes place, if the capacitance of the system is kept low, in about 100 ns.

The duty cycle, d, is given by $d=t_{ON}/(t_{ON}+t_{OFF})$, while the pulse repetition frequency, PRF, is given by $PRF=1/(t_{ON}+t_{OFF})$. The drive waveform alternates between positive-going and negative-going pulses to maintain an average.voltage of zero across the lamp. The peak pulse voltage, $V_p$, will vary because of the constant average power nature of the system, as described below. Its maximum value is 1.4 kV.

Figure 5:
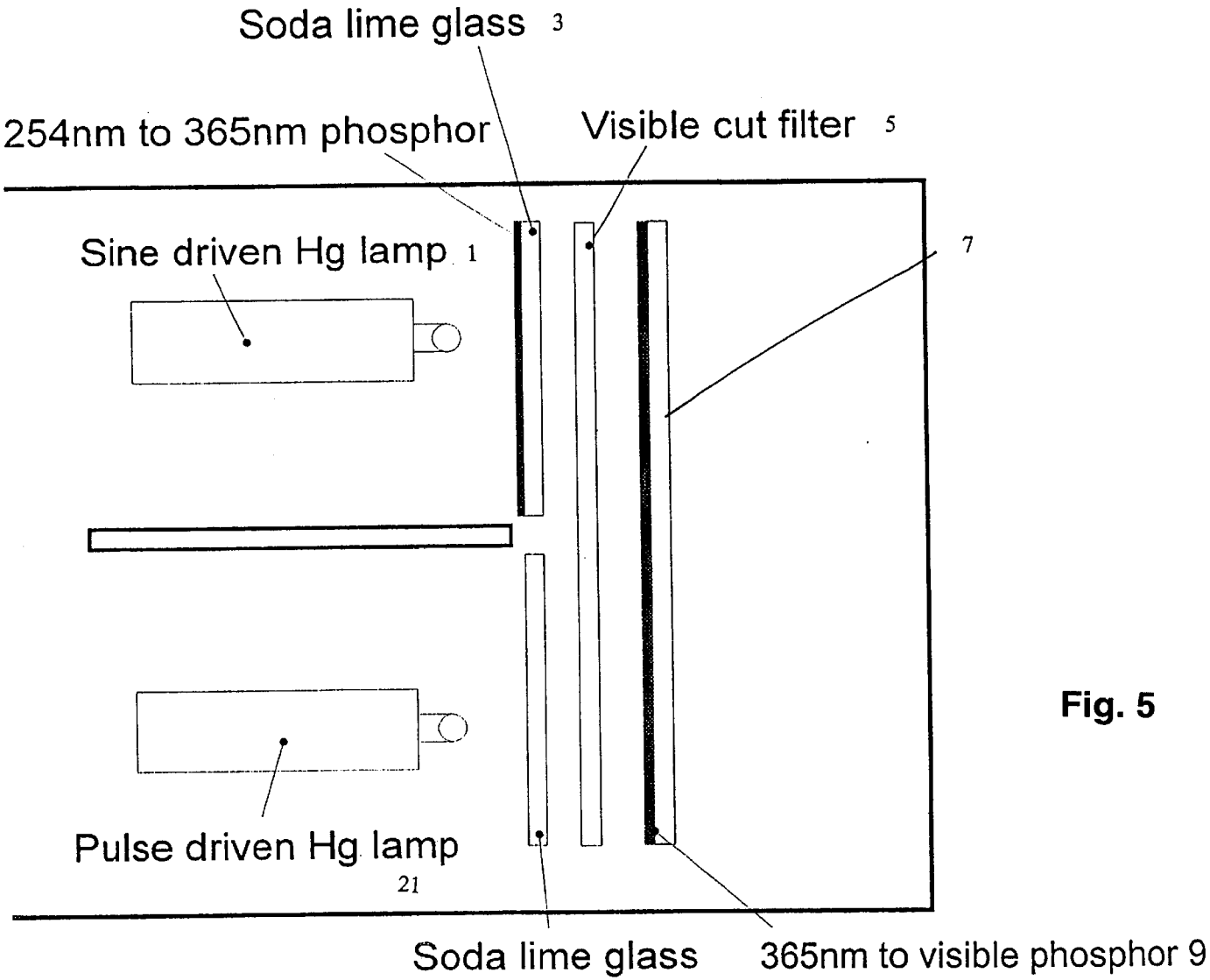
FIG. 5 shows the experimental setup for comparing lamp arrangements of the prior art and of the invention.

The construction of the lamp is largely the same as a standard Hg lamp, except for the drive circuit, likewise to be discussed below. A demonstration unit to contrast the two different routes to producing visible radiation was constructed to the design shown in FIG. 5. Two lamps of identical construction were placed on either side of a partition in an enclosure. The construction of the lamps was largely the same as a standard mercury lamp: triple-oxide-coated, triple-coiled electrodes at the ends of each of the lamps were heated with equal powers by independent heater circuits. The U-shaped lamps with a discharge path of length 100 mm were constructed of silica. The lamps were both dosed with mercury and argon and neither lamp was coated with phosphor. One lamp was driven by a conventional high-frequency (33 kHz) alternating supply; the other by a pulsed power supply described below. The argon pressure was 5 torr, though a wide range of pressures, say 2–50 torr, is usable; the mercury pressure corresponded to a wall temperature of 27° C. The configuration of FIG. 5 is chosen to simulate the use of lamps as backlights for UV/phosphor-type LCDS.

Figure 9:
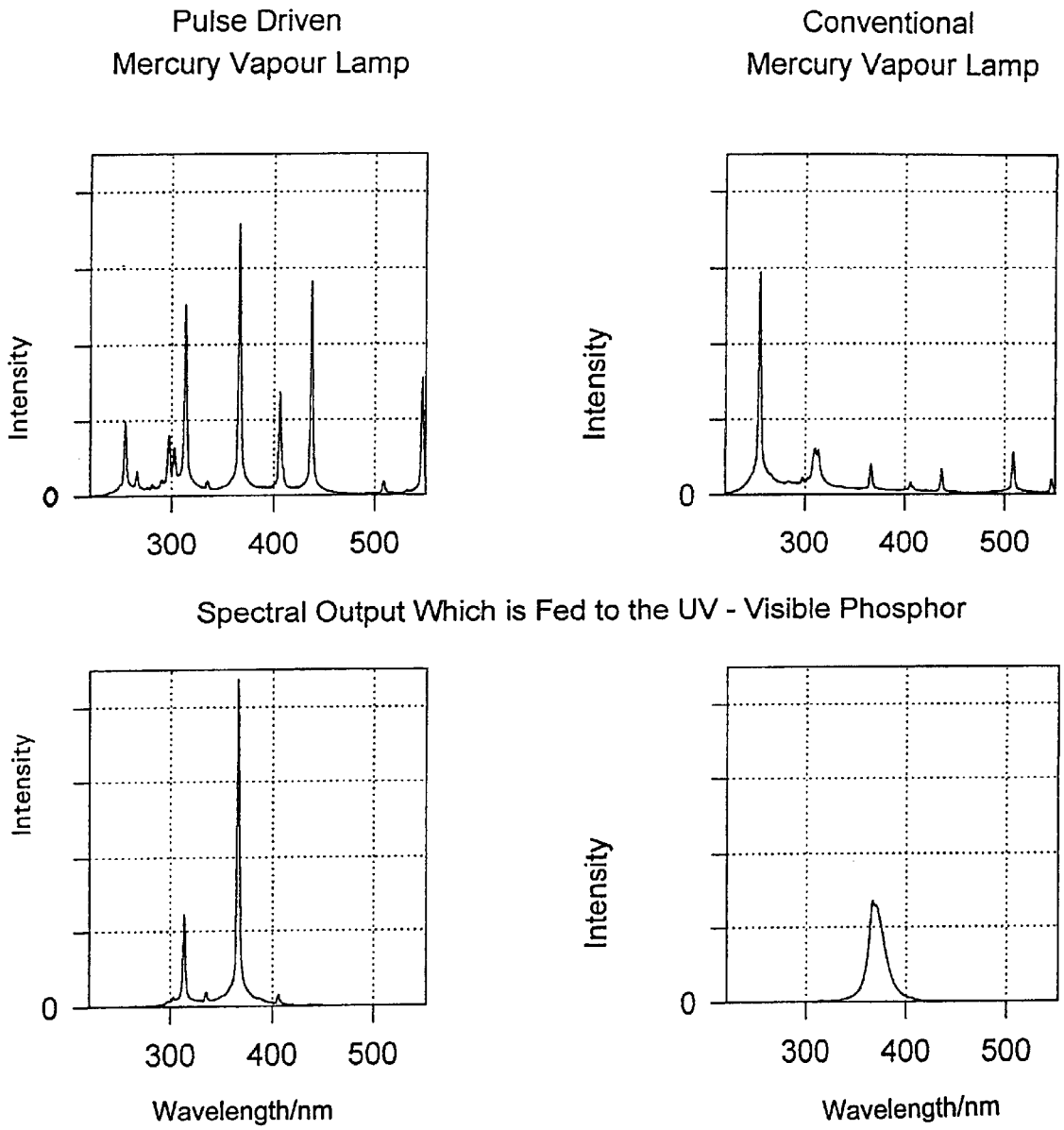
FIG. 9 shows the outputs of the lamps illustrated in FIG. 5.

The emissions of each lamp are shown in the upper part of FIG. 9. The lamp driven by a conventional circuit emits predominantly at 254 nm, the other lamp predominantly at 366 nm. The 254 nm emission from the conventionally driven lamp was firstly converted to 366 nm with a converting phosphor coated on soda-lime glass to remove any UV below about 300 nm. The emissions from both lamps were then filtered to remove any visible radiation; the resulting emissions are shown in the lower part of FIG. 9. Finally, both were used to excite a phosphor converting 366 nm to visible radiation. For the situation where for the given operating conditions, and where both the heater powers and the total powers dissipated were the same in each lamp, the lamp driven by the pulsed circuitry was 300% brighter.

Figure 6:
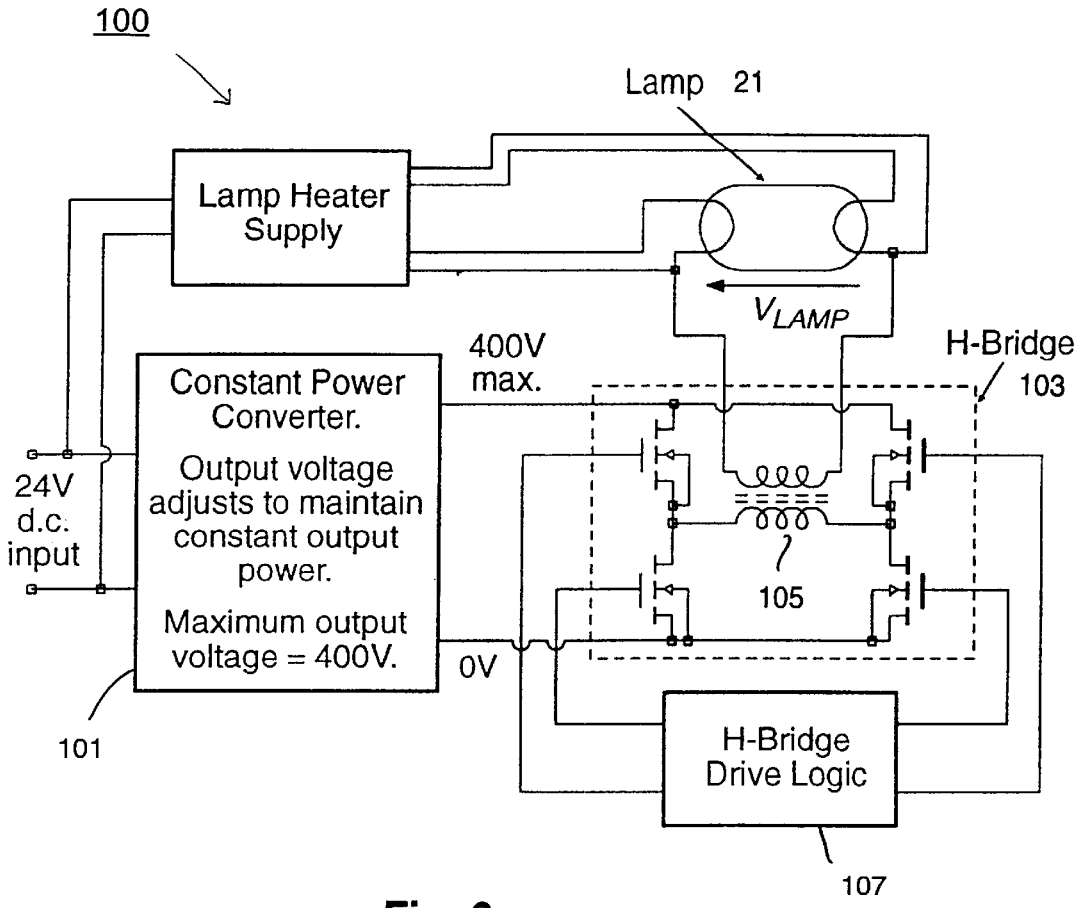
FIG. 6 shows the circuit used in an embodiment of the invention.
Figure 7:
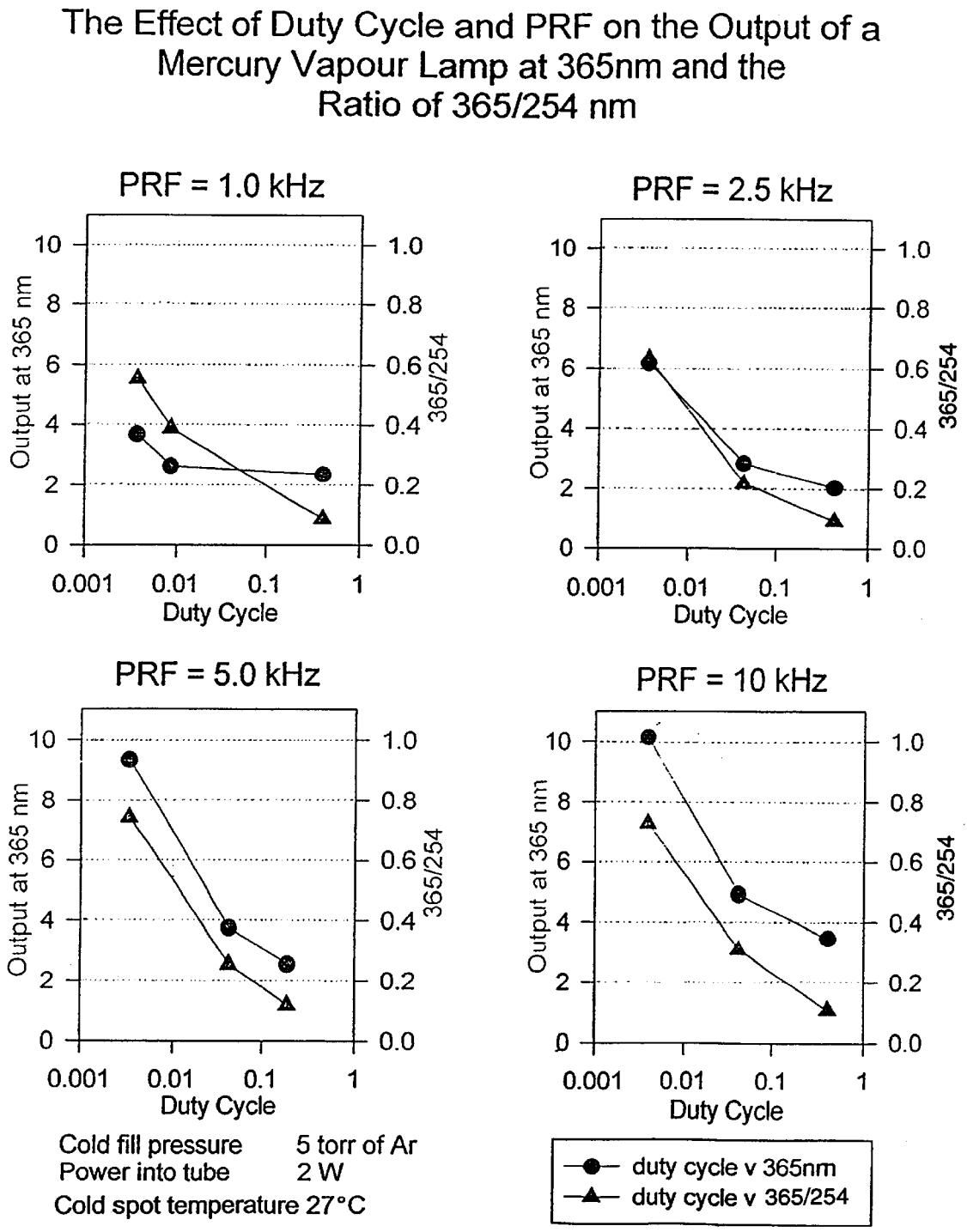
FIG. 7 shows experimental results for the effect of duty cycle and PRF (pulse repetition frequency) on the output of a mercury lamp.

FIG. 6 shows the circuit used for this embodiment. A constant-average-power converter 101 outputs a power of, say, 2 W with a maximum voltage of 400 V. The output is placed over an H-bridge of enhancement-mode MOSFETs, the central bar of which is formed by an inductor 105, itself part of a transformer whose output is applied to the electrodes of the lamp 21, at a maximum voltage of about 1400 V. The drive logic 107 turns the respective transistors on and off to give alternately opposite pulsed currents through the inductor 105 and hence the desired pulse waveform as exemplified in FIG. 4A. It can be seen clearly from FIG. 7 that, particularly at frequencies over 1 kHz, lowering the duty cycle increases the 366 nm output and the ratio of this output to that at 254 nm. This is thought to be due to the concentration of spectral lines at 365–366 nm, all of which are excited in the pulsed excitation mode.

In the experiments a ratio of about 2:1 was obtained at duty cycles of about $3\times10^{-3}$, and there seems no reason why still higher rates should not be obtained. Of course, lowering the duty cycle lowers the total power output for a given maximum pulse height, so a compromise has to be reached, the useful lower limit is about $10^{-3}$.

Figure 8:
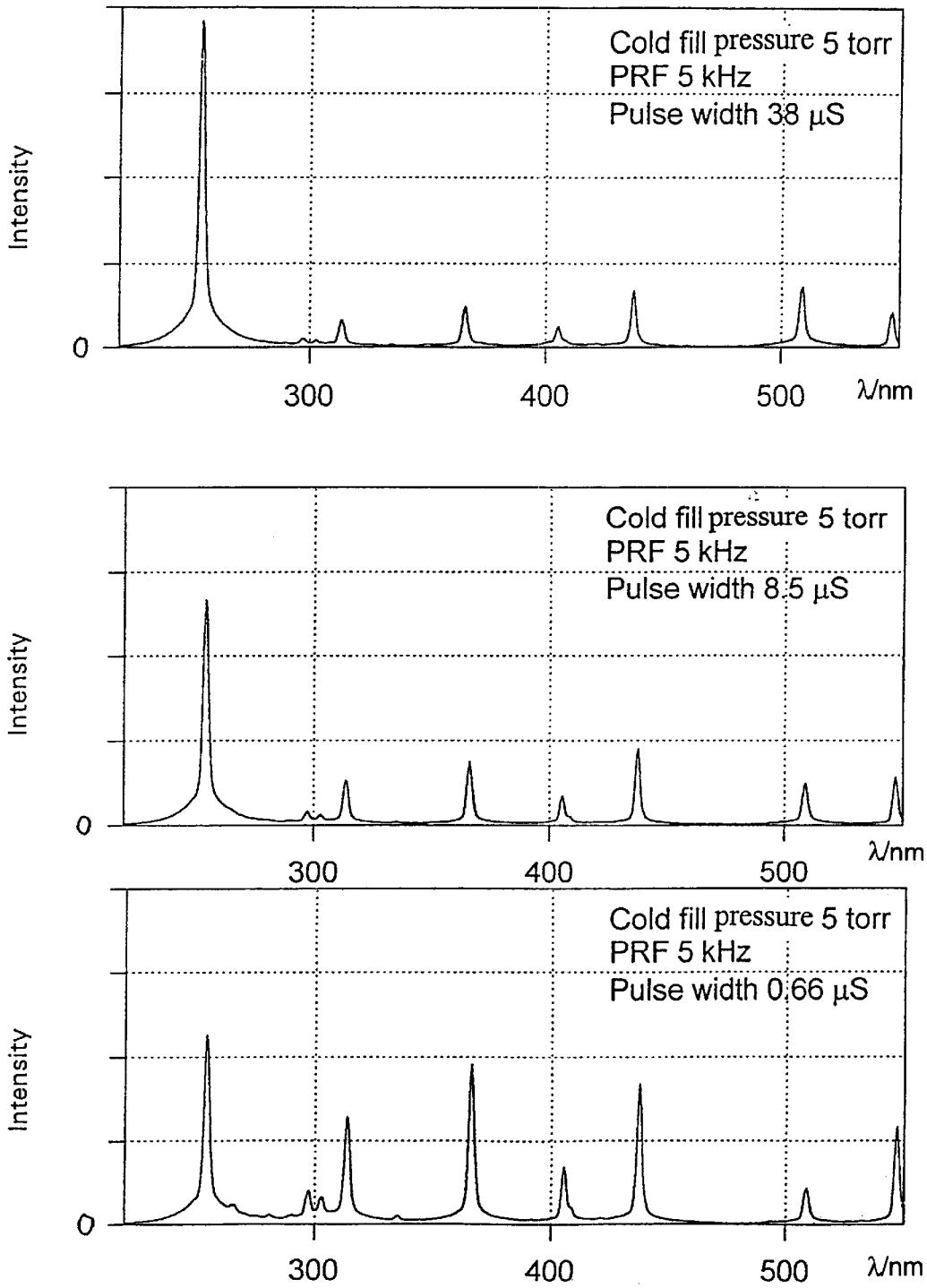
FIG. 8 shows the spectral output of lamps driven in accordance with the invention.

FIG. 8 shows the variation in the entire spectrum as the duty cycle is reduced at a constant 5 kHz repetition rate; the three graphs have respective duty cycles of 0.19, 0.043 and 0.0033. It should be noted that the 508 nm line is an artefact of the system, representing only a doubling of the 254 nm line.

The effect of the biasing of the discharge output towards the 366 nm emission can be seen in the graphs of FIG. 9, which compare the UV emissions and the resulting (filtered) phosphor-stimulating input of the two lamps. The graphs on the right, for the conventional (non-pulsed) lamp, show that by far the greatest emissions occur at 254 nm, which results in a correspondingly low output at 366 nm (from the intermediate phosphor layer). The graphs on the left, with the predominant discharge line already at 366 nm, give a much higher and sharper peak at 366 nm. Note that the intensities shown on the vertical axes are not to scale.

Figure 10:
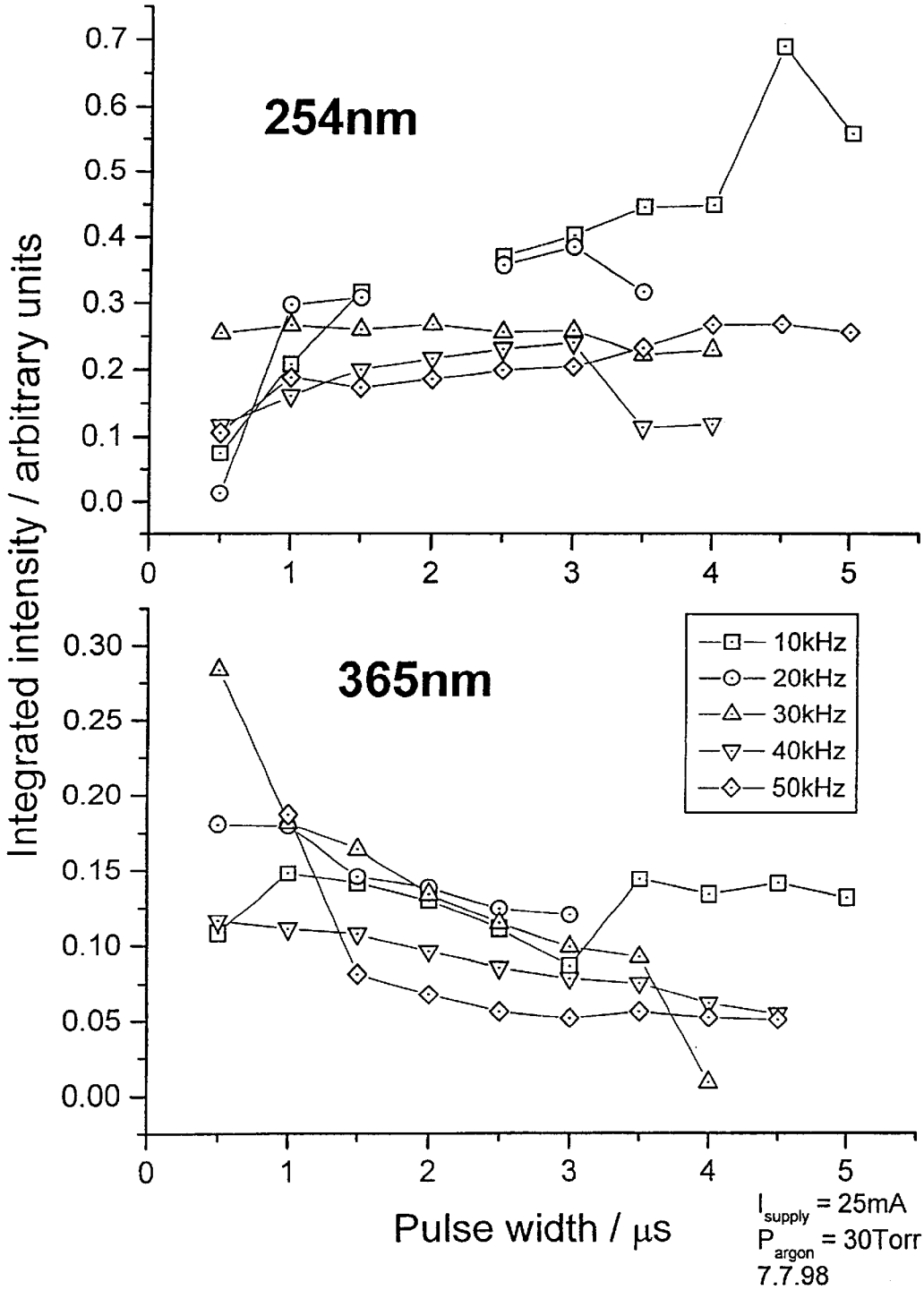
FIGS. 10 to 12 show the results of further investigation into the behaviour of some of the mercury lines during pulsed excitation.

FIG. 10 shows the behaviour of the 254 nm and 365 nm emissions for different pulse widths and frequencies. It demonstrates that over the pulse width range 0.5 μs to 5 μs and the frequency range 10–50 kHz the 365 line decreases in intensity with increasing width while the 254 line increases. For both lines the intensity increases with decreasing frequency, even though the mean current is kept constant.

Figure 11:
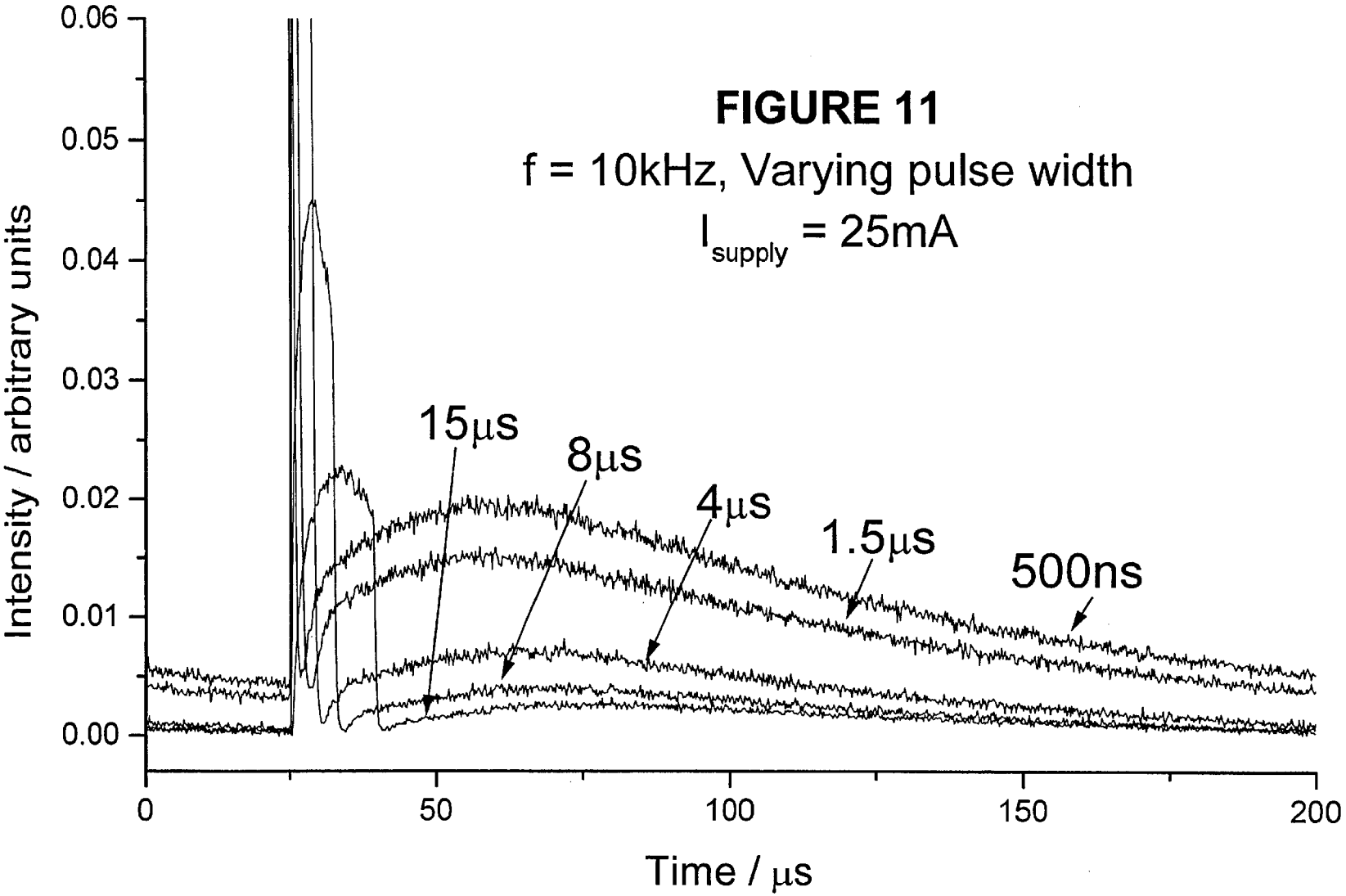

FIG. 11 shows in more detail and greater time resolution the behaviour of the 365 nm emissions for pulses of varying length at a constant frequency of 10 kHz and a constant average discharge current. It can be seen that the shorter the pulse the higher the initial peak; this is a consequence of the requirement for a given average output. It further appears that the shorter the pulse the higher the subsequent output of the 365 nm radiation, with a significant amount of emission ("afterglow") in the few dozen microseconds after the pulse for pulses shorter than about 2 μs. It seems plausible that a pulse of higher than normal voltage is required in order to fill some of the higher energy states of the gas mixture, that then decay to "feed" the 365 nm transition, but this is conjecture.

Figure 12:
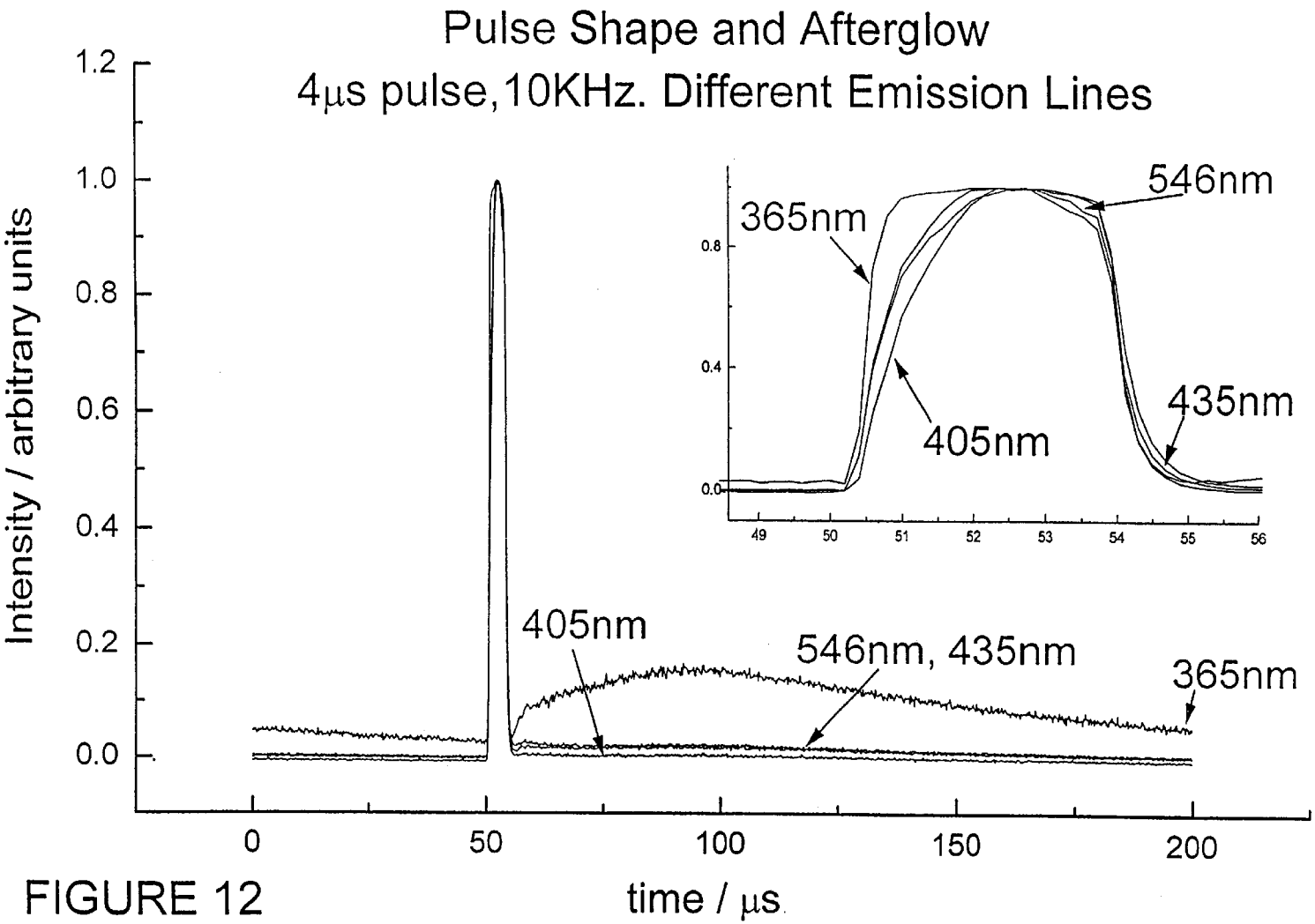

FIG. 12 shows a simple spectral analysis of the afterglow for a 4 μs pulse at 10 kHz. It is strikingly apparent that there is virtually no afterglow for the 405, 435 and 546 nm lines, by comparison with the 365 nm line. The 254 nm line is not shown here.

Figure 13:
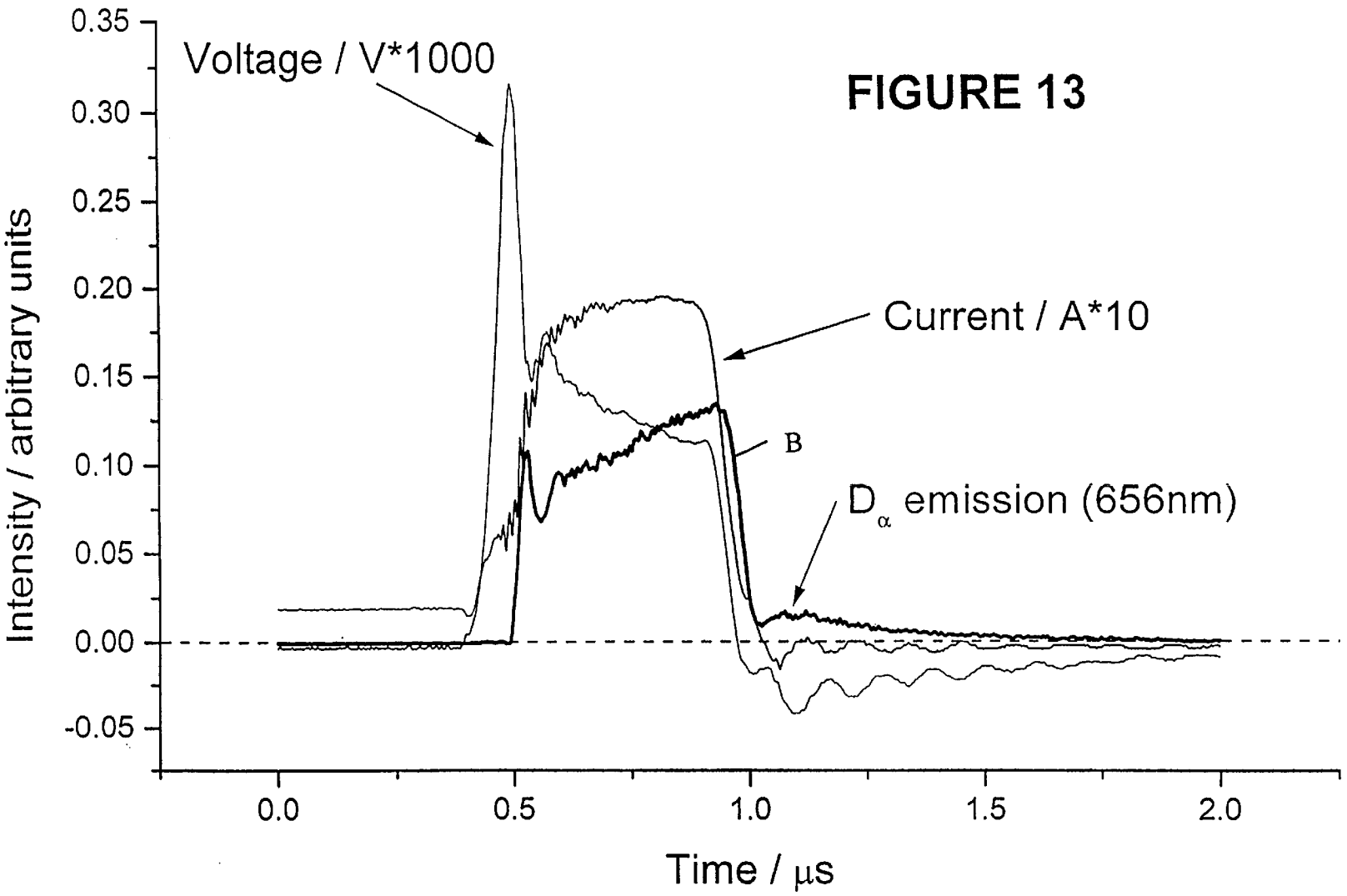
FIG. 13 shows the intensity of the 656 nm deuterium line for pulsed excitation.

FIG. 13 shows a pulsed discharge for a (pure) deuterium discharge, V being the applied voltage, A the current and B the intensity trace of the 656 nm emission line. Here it can be seen that there is a small afterglow for this line, whereas other D lines do not show this effect; hence pulsed excitation can bias the output of the 656 nm line by comparison with the other spectral lines of the deuterium spectrum.

It is possible to improve the efficiency of the system still further by attending to the pulse shape design. In system designs which include no auxiliary starter circuits or electrodes it is advisable to choose a leading edge time profile that minimises damage to the electrodes during the rapid current-voltage increase at the beginning of the pulses: if the voltage is ramped then as it rises certain processes start in the medium which help to initiate the discharge reliably, without too high a maximum pulse voltage. Secondly, the duration of the pulse should be as short as possible, because it is the main steady-state wavelength which predominates during this time. Thirdly, the termination of the pulse should be as rapid as possible. In particular the pulse should have an asymmetrical nature or profile. A generally favourable pulse profile has a ramped rise from zero volts to a maximum voltage where there is a nearly instantaneous fall to zero volts, with no intervening plateau.

The inter-pulse time (i.e. pulse repetition frequency) is a function of the chosen lamp operating conditions (i.e. the lamp's wall temperature, fill gas composition and fill gas pressure).

What is claimed is:

1. A discharge lamp having a light output, the lamp comprising a tube containing a discharge medium and a control means for applying a field to the medium so as to cause a discharge within the tube, wherein the discharge in the medium if excited by a simple alternating field contains two lines at first and second wavelengths with the first wavelength predominating in terms of intensity, the control means being adapted to apply a waveform consisting of excitation pulses of relatively short width and non-excitation intervals of relatively long width such that the integral over one waveform period of the intensity of the discharge at the second wavelength is greater than the corresponding integral for the first wavelength.

2. The discharge lamp of claim 1 wherein the waveform has a duty cycle of between $10^{-1}$ and $10^{-3}$.

3. The discharge lamp of claim 2 wherein the duty cycle is about $10^{-2}$.

4. The discharge lamp of claim 1 wherein the medium has a gas pressure in the range of from about 2 torr to about 50 torr and the wall temperature is in the range of from about 25° C. to about 30° C.

5. The discharge lamp of claim 4, in which the gas pressure is in the range of from about 5 torr to about 30 torr.

6. The discharge lamp of claim 1 wherein the pulse width is less than about 1 μs, the waveform frequency is in the range of from about 5 kHz to about 10 kHz, and the maximum waveform voltage is about 1.4 kV and the waveform current is about 1 A during the pulse.

7. The discharge lamp of claim 6 wherein the pulse width is less than 0.5 μs.

8. The discharge lamp of claim 1 wherein the active component of the discharge medium is mercury, the remainder of the discharge medium is a rare gas, the first wavelength is about 254 nm, and the second wavelength is about 366 nm.

9. The discharge lamp of claim 1 wherein the light output is produced directly by the discharge.

10. The discharge lamp of claim 1 wherein the light output is produced by the response of a phosphor-type coating on the tube to both the first and second wavelengths.

11. A discharge lamp having a light output, the lamp comprising a tube containing a discharge medium having an active component of mercury and a gas pressure in the range of from about 2 torr to about 50 torr, and a control means for applying a field to the medium so as to cause a discharge within the tube, wherein the discharge in the medium if excited by a simple alternating field contains two lines at a first wavelength of about 254 nm and second wavelength of about 366 nm with the first wavelength predominating in terms of intensity, the control means being adapted to apply a waveform consisting of excitation pulses of less than about 1 μs and non-excitation intervals resulting in a duty cycle of between $10^{-1}$ and $10^{-3}$, the maximum waveform voltage being about 1.4 kV and the waveform current being about 1 A during the pulse, the integral over one waveform period of the intensity of the discharge at the second wavelength being greater than the corresponding integral for the first wavelength.

12. The discharge lamp of claim 11 wherein the duty cycle is about $10^{-2}$.

13. The discharge lamp of claim 11 wherein the gas pressure is in the range of from about 5 torr to about 30 torr.

14. The discharge lamp of claim 11 wherein the pulse width is less than 0.5 μs.

15. The discharge lamp of claim 11 wherein the light output is produced directly by the discharge.

16. The discharge lamp of claim 11 wherein the light output is produced by the response of a phosphor-type coating on the tube to both the first and second wavelengths.

17. A discharge lamp comprising a discharge medium, an enclosure for the medium, and means for applying an electric field to the medium, in which the wall of the enclosure is coated with a phosphor-type material emitting at a wavelength $\lambda$ and the field-applying means is adapted to apply the field in a pulsed manner at a frequency and duty cycle such that the medium discharges radiation at a wavelength $\Lambda$, wherein $\Lambda/\lambda>0.6$.

18. A display comprising a discharge lamp and a shutter means, the lamp including a discharge medium, an enclosure for the medium, and means for applying an electric field to the medium, and the shutter means receiving radiation discharged from the lamp, the shutter means switching the radiation in order to allow it selectively to strike a phosphor-type emitter having a mean emission wavelength $\lambda_{\cdot}$, in which the radiation wavelength $\Lambda$ is close to the phosphor wavelength $\lambda_{\cdot}$.

19. The display of claim 18 wherein the radiation wavelength $\Lambda$ is at least 0.6 times the phosphor wavelength $\lambda_{\cdot}$.

20. A method of operating a discharge lamp, in which an electrical signal is applied to a discharge lamp comprising a tube in which a discharge medium is contained in order to cause a discharge within the tube, wherein the discharge in the medium if excited by a simple alternating field contains two lines at first and second wavelengths, the first wavelength predominating in terms of intensity, in which the signal consists of relatively short pulses and relatively long non-excitation intervals such that the integral over one signal period of the intensity of the light emitted at the second wavelength is greater than the corresponding integral for the first wavelength.

21. A method of driving a discharge by applying an electrical signal to a discharge medium, said medium exhibiting a transient response to an applied voltage pulse and reaching a subsequent state if said pulse is not terminated, said subsequent state being when the voltage and current of said pulse have reached substantially constant values, said method comprising applying said electrical signal as pulses, each electrical signal pulse being terminated before said medium reaches said subsequent state.

22. The method of claim 21 wherein the signal is ended when a parameter of the discharge that rises on application of a pulse reaches about half of its steady-state value.

23. The method of claim 21 wherein the width of the pulse is less than 0.5 $\mu$s.

24. The method of claim 21 wherein the active component of the discharge medium is mercury and the remainder of the discharge medium is a rare gas.

* * * * *